US006012527A

United States Patent [19]

Nitis et al.

[11] Patent Number: 6,012,527

[45] Date of Patent: Jan. 11, 2000

[54] METHOD AND APPARATUS FOR DRILLING AND RE-ENTERING MULTIPLE LATERAL BRANCHED IN A WELL

[75] Inventors: Spyros S. Nitis, Missouri City; Herve Ohmer; Mikhail V. Gotlib, both of Houston, all of Tex.

[73] Assignee: Schlumberger Technology Corporation, Sugar Land, Tex.

[21] Appl. No.: 08/937,032

[22] Filed: Sep. 24, 1997

Related U.S. Application Data

[60] Provisional application No. 60/027,241, Oct. 1, 1996, provisional application No. 60/035,425, Jan. 22, 1997, and provisional application No. 60/044,422, Apr. 29, 1997.

[51] Int. Cl.[7] ..... E21B 43/14

[52] U.S. Cl. ..... 166/313; 166/50; 175/61

[58] Field of Search ..... 166/313, 50, 117.5, 166/117.6; 175/61

[56] References Cited

U.S. PATENT DOCUMENTS

| | | |
|---|---|---|
| 2,397,070 | 3/1946 | Zublin . |
| 2,797,893 | 7/1957 | McCune et al. . |
| 2,858,107 | 10/1958 | Colmerauer . |
| 4,153,109 | 5/1979 | Szescila . |
| 4,304,299 | 12/1981 | Holland et al. . |
| 4,415,205 | 11/1983 | Rehm et al. . |
| 4,497,371 | 2/1985 | Lindsey, Jr. . |

(List continued on next page.)

FOREIGN PATENT DOCUMENTS

| | | |
|---|---|---|
| 0 574 326 A1 | 12/1993 | European Pat. Off. . |
| 192114 | 2/1967 | U.S.S.R. . |
| 2 274 864 | 1/1996 | United Kingdom . |
| 2 304 760 | 3/1997 | United Kingdom . |
| WO 93/05266 | 3/1993 | WIPO . |
| WO 95/33910 | 12/1995 | WIPO . |
| WO 96/23953 | 8/1996 | WIPO . |
| WO 98/07957 | 2/1998 | WIPO . |

OTHER PUBLICATIONS

Collins, Dan, "Single–Size Reduction Offers Workover, Completion Advantages", *Petroleum Engineer International* (Jan. 1996), pp. 59–62.

"Multilateral Technology: Taking Horizontal Wells To The Next Level", a supplement to *Petroleum Engineer International* (1997).

"Multi–Lateral Product Overview", TIW Window Cutting Products Division, 46 pages, No date.

European Search Report from Applicants' European Counterpart Application No. EP 97307658, Feb. 02, 1999.

*Primary Examiner*—William Neuder

*Attorney, Agent, or Firm*—James L. Jackson; Wayne I. Kanak

[57] ABSTRACT

A method and apparatus for landing and orienting selected tools to selected depths within a well casing. The well casing is provided with a plurality of casing nipples located at selected depths with each of the landing and orienting joints defining a differing internal landing profile and having a mule shoe therein defining an upwardly facing point and an orientation slot and having helical guide ramp surfaces extending from the point to the orientation slot. A landing-orientation tool is adapted to be run into the casing and has an outer tubular body mandrel positioning a plurality of landing dogs for landing engagement with a matching landing profile of one of the casing nipples and positioning an orientation key for guided engagement with the helical guide ramp surfaces and for tool orienting engagement within the orientation slot. The landing-orientation tool has an inner tubular actuator mandrel being linearly positionable at a running position where the landing dogs and orientation key are radially yieldable to pass over internal obstructions in the casing string and a locking position where the landing dogs and orientation key are locked with respect to the matching landing profile of a landing and orienting joint. The tool being run will pass through non-matching landing and orienting joints and will land only when its landing dogs have a landing profile matching the profile of a landing and orienting joint.

26 Claims, 8 Drawing Sheets

U.S. PATENT DOCUMENTS

| | | | |
|---|---|---|---|
| 4,665,995 | 5/1987 | Braithwaite et al. . | |
| 4,807,704 | 2/1989 | Hsu et al. . | |
| 4,921,044 | 5/1990 | Cooksey . | |
| 5,301,760 | 4/1994 | Graham . | |
| 5,311,936 | 5/1994 | McNair et al. . | |
| 5,318,121 | 6/1994 | Brockman et al. . | |
| 5,318,122 | 6/1994 | Murray et al. . | |
| 5,322,127 | 6/1994 | McNair et al. . | |
| 5,325,924 | 7/1994 | Bangert et al. . | |
| 5,353,876 | 10/1994 | Curington et al. . | |
| 5,375,659 | 12/1994 | Gilbert et al. . | |
| 5,388,648 | 2/1995 | Jordan, Jr. . | |
| 5,398,754 | 3/1995 | Dinhoble . | |
| 5,439,051 | 8/1995 | Kennedy et al. . | |
| 5,454,430 | 10/1995 | Kennedy et al. . | |
| 5,458,209 | 10/1995 | Hayes et al. . | |
| 5,462,120 | 10/1995 | Gondouin . | |
| 5,474,131 | 12/1995 | Jordan, Jr. et al. . | |
| 5,477,925 | 12/1995 | Trahan et al. . | |
| 5,520,252 | 5/1996 | McNair . | |
| 5,564,503 | 10/1996 | Longbottom et al. . | |
| 5,566,763 | 10/1996 | Williamson et al. . | |
| 5,651,415 | 7/1997 | Scales . | |
| 5,730,224 | 3/1998 | Williamson et al. . | |
| 5,735,350 | 4/1998 | Longbottom et al. . | |
| 5,762,149 | 6/1998 | Donovan et al. | 166/50 |
| 5,785,133 | 7/1998 | Murray et al. | 175/61 |

FIG. 15
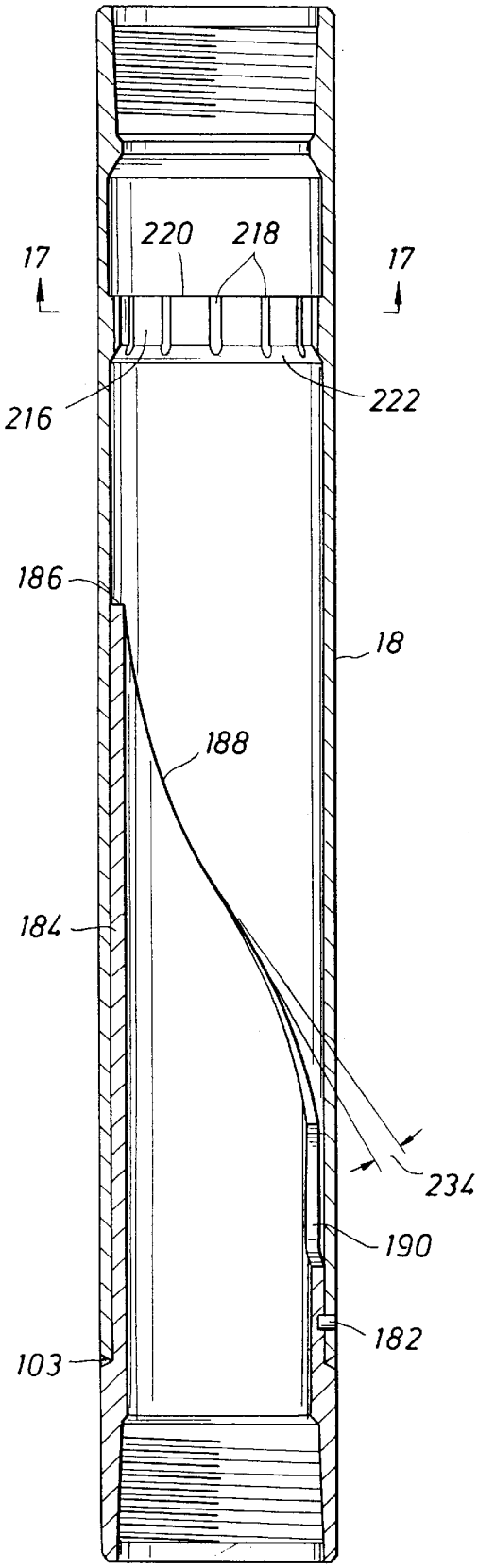
FIG. 10
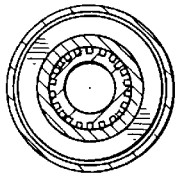
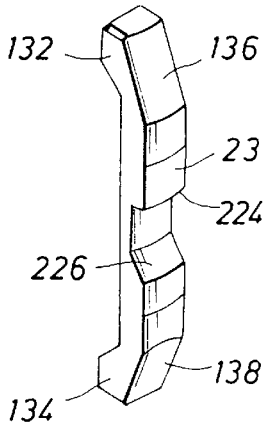
FIG. 16
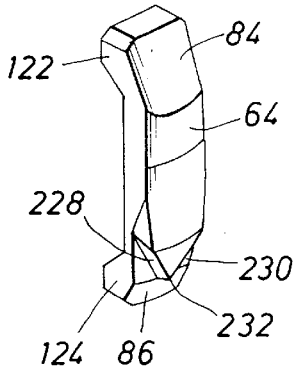
FIG. 17
FIG. 18
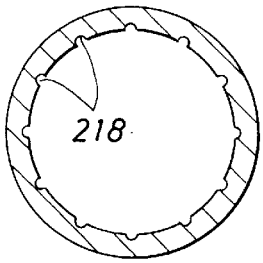

METHOD AND APPARATUS FOR DRILLING AND RE-ENTERING MULTIPLE LATERAL BRANCHED IN A WELL

CROSS-REFERENCE TO RELATED APPLICATIONS

This application claims priority from Provisional Application No. 60/027,241, filed Oct. 1, 1996, from Provisional Application No. 60/035,425, filed Jan. 22, 1997, and from Provisional Application No. 60/044,422, filed Apr. 29, 1997, each of which is incorporated herein by reference.

BACKGROUND OF THE INVENTION

1. Field of the Invention

This invention relates generally to wells for the production of petroleum products and more particularly concerns lateral branches from a primary wellbore. More specifically the present invention concerns the provision of a method and apparatus for landing and orienting downhole tools at well depths established by casing nipples to enable the efficient conduct of subsequent downhole operations. As a more specific example, the present invention is useful during the operation of providing multilateral branches from a primary wellbore and their future reentry through the casing string of the well. Even more specifically the invention concerns the provision of a method and apparatus having the principal function of positioning, orienting and locking milling or deflection assemblies relative to a selected landing and orienting joint of the casing string of the well and locking the apparatus within the landing profile of the selected landing and orienting joint.

2. Description of the Related Art

In oil and gas production wells, or water or steam wells, conventional side-tracking methods that have been used to drill lateral branches from a parent wellbore generally require the setting of a temporary locating device within the casing of the parent wellbore. A temporary locating device for this purpose may be a plug, whipstock or any suitable type of expanding means that is anchored within the well casing by frictional engagement with the inner surface of the casing. These plugs are sometimes unstable due to their frictional retention within the casing, so they cannot be relied on to provide a reliable depth and orientation reference within the casing. Also, when frictional plugs or whipstocks of this nature are removed from the casing, their depth and angular reference for lateral branching is lost. Thus, to reenter a lateral branch that has been drilled, the depth and angular reference must be accurately reestablished. This is often a difficult, time consuming and expensive procedure that adversely influences the cost of well completion. Therefore, it is desirable to provide the well casing with means for establishing a permanent depth and angular reference and known orientation from which lateral branches can be selectively reentered. It is also desirable to simplify the construction of multiple lateral wellbore branches and to reduce the risk of failure during the side-tracking process.

Until a number of years ago virtually all wells drilled and completed for production of petroleum products were vertical wells. More recently it has been found to be quite beneficial to drill and complete horizontal or lateral wellbores so that a substantial length of the wellbore will be present in a productive formation and thus, particularly in marginal zones, will provide greater opportunity to produce the petroleum products that are present therein. Horizontal drilling procedures and equipment have been developed to drill wellbores which are diverted from the vertical at a particular depth and result in the location of a section of wellbore which is at or near the horizontal or which is selectively oriented for positioning in a production zone. Well drilling and completion procedures and equipment have more recently been developed to accomplish drilling of multilateral branches from wells, typically wells having wellbores that are lined with well casing. Typically multilateral branches are drilled by first milling a window in the casing at a desired depth. A milling whipstock is located within the well casing at a selected depth and provides an orienting geometry for orienting and deviating a casing milling tool in a manner designed to achieve the milling of a casing window having a desired angle for subsequent lateral branch drilling operations at a desired lateral branch angle and a desired azimuth. Lateral branches of the well are then drilled from one or more casing windows and are completed in a manner accomplishing desired production of petroleum products.

After casing windows have been milled and a drilling whipstock facilitating milling of a casing window and drilling of a lateral branch wellbore has been removed from the well casing, when reentry of a casing window is desired, it has been found exceedingly difficult to locate such windows and to locate equipment within the well casing at the proper depth and in the proper position for entering the casing windows and accomplishing lateral branch operations. For lateral branch reentry a deflection tool, i.e., drilling whipstock, deflector whipstock or the like must be precisely positioned at a desired well depth and must be precisely rotationally oriented with respect to the desired azimuth of the lateral branch to be drilled. Such positioning is quite difficult and time consuming to accomplish. Even in the case of small errors in deflector location, it is likely that the reentry tool will miss the casing window or become lodged on the edges of the window. It is also likely that these small errors will cause the tool to be misdirected slightly from the standpoint of azimuth or inclination so that the branch wellbore is not precisely tracked by the tool. It is desirable therefore to provide means for positively locating branch wellbore drilling and completion equipment within a well casing to facilitate drilling of lateral branch wellbores and which, subsequent to removal of branch wellbore drilling equipment from the well casing, facilitates precise depth location and precise rotational orientation of various types of equipment for precision lateral branch reentry. It is further desirable to provide means for efficient drilling and completion of lateral branch wellbores to facilitate simple and efficient preparation of a well having multilateral branch wellbores at selected depths and azimuths for completion and subsequent production, as well as providing for efficient reentry of selected multilateral branches for well servicing activities.

SUMMARY OF THE INVENTION

It is a principal feature of the present invention to provide a method and apparatus enabling the orientation and landing of a tool within a selected one of a plurality of landing and orienting joints of a casing string of a well so that other well tools supported and positioned thereby can be effectively utilized for carrying out downhole activities requiring orientation at a specified angle.

It is another feature of the present invention to provide a novel landing-orientation tool which is adapted for connection to a whipstock in the case of window milling in the casing and adapted for connection to a deflection whipstock in the case of a lateral branch re-entry operation.

It is also a feature of the present invention to provide a novel landing-orientation tool having the facility for selecting one of a plurality of landing and orienting joints of a well casing while bypassing other landing and orienting joints for selective location of a tool connected thereto at a desired depth within the well casing.

It is an even further feature of the present invention to provide a novel landing-orientation tool having landing dogs of a particular profile which permits landing of the tool within a landing and orienting joint of the well casing with a matching profile while bypassing landing and orienting joints of a differing profile.

It is another feature of the present invention to provide a plurality of landing and orienting joints connected at various selected depths within a casing string and each having therein a mule shoe device defining a pointed upper end and defining an orientation slot and having curved guide ramps extending oppositely from the point to the orientation slot and functioning to establish angular orientation of a well tool passing through the landing and orienting joint.

It is an even further feature of the present invention to provide a novel landing-orientation tool having an orientation key projecting radially therefrom and being adapted for engaging curved guide ramps of a mule shoe of a landing and orienting joint and for engaging within the orientation slot of a mule shoe to provide for effective orientation of the tool relative to the landing and orienting joint.

It is an even further feature of the present invention to provide a novel landing-orientation tool having an orientation key defining a downwardly facing, generally pointed end defining angularly oriented guide surfaces being oriented at the same angle as the angle of the helically curved guide ramps of the mule shoe of a landing and orienting joint so as to provide a bearing function as well as a guiding function with respect to the helical guide ramp being engaged.

Briefly, the various objects and features of the present invention are realized through the provision of a special pressure-tight casing joint that is connected to the bottom of a casing section that is intended to be opened for side-tracking. This special casing joint is designed and made so tools can be accurately and reliably located and orientated with respect to the local coordinates of the well at the location of the lateral branching. The landing and orienting device consists of a centering section that determines the position of running or setting tools in the cross-sectional plane of the well at the level of a branch junction. Another feature provides the capability for building a cylindrical reference area with tight tolerances at the top of the landing and orienting device to thus enable various tools and devices to be located within the well casing with considerable precision from the standpoint of depth and angular orientation. A longitudinal location system is provided that determines the location of running or setting tools along the longitudinal axis of the parent wellbore by providing a circular internal groove having a specific profile that can be matched by mating keys carried by the running or setting tools as is commonly done on production tubing nipples. An orienting locator is also provided that determines the angular position of running or setting tools around the longitudinal axis of the parent wellbore. This orienting locator provides an orienting slot located at the bottom of a cam profile so that a matching orienting key of a tool traversing the casing of the wellbore can fit into the orienting slot from any angular position by means of an orienting cam edge of an orienting device known as a "mule shoe". This angular reference recopies the position of the orienting key on the outside of the joint.

The landing and orienting joint of the pressure tight casing joint provides an internal latching area that allows running or setting tools to be secured in the pre-set position with respect to the landing and orienting joint. The longitudinal locating groove is used to support forces developed by the tools along and perpendicular to the axis of the parent wellbore. In the same way, the torque developed by the tools is supported by the orienting slot. Mating keys are provided on running or setting tools and are designed so that the tools can seat in only one of a number of predetermined joints by matching the profile of the mating keys with that of respective seats. Conversely, any individual landing and orienting casing joint may have a specific key profile and the tools may be equipped with a standard key that could match any or a given set of joints. This feature is commonly used on several downhole completion tools.

The locating and orientating casing joint may have an additional feature that allows the orienting key to be adjusted in orientation at the wellsite when making-up the casing string. This important feature allows stacking multiple casing sections equipped with their respective landing and orienting joints to be oriented relative to each other with a desired relative departure angle. The landing and orienting casing joint may have an additional feature that isolates from the torque produced on the joint below the orienting key. This feature allows orienting all or a part of the upper section of the casing string when running the casing downhole in a manner that disregards the frictional torque acting on the lower section of the casing string. This can be accomplished by integrating a swivel joint at the lower end of the landing and orienting joint. The landing and orienting joint may be fastened to the casing section with threaded ends, the same way as conventional casing joints. It is also possible to build the landing and orienting section in the same part as the casing section that is intended to make a lateral junction.

The landing and orienting joint does not alter the standard mechanical properties of a casing string. The casing string may support as many landing and orienting joints as required to build one or more multiple lateral branches during construction of the well. Some joints may be installed to provide for future branching. As a further alternative, lateral branches may be constructed just after the casing string is set within the wellbore and cemented in place or, in the alternative, may be constructed later during the life of the well from landing and orienting joints that are provided in the well casing for such purpose. The same concept recursively applies to branches, meaning that one or more lateral branches may be built following the same technique in a primary lateral branch. The casing joint section can be made of any standard steel pipe that is used for well casing. It can also be made of any suitable material that would ease the branching process particularly by facilitating the casing window cutting procedure for initiating branch wellbore construction. The casing joint section can also be combined with any pre-fabricated branching element such as a pre-milled casing window or composite junctions that are installed in line with the parent casing.

From the standpoint of apparatus, well casing is provided having integrally connected therein at selected well depths a plurality of casing nipples each having a differing internal landing profile. A landing-orientation tool is provided having replaceable landing dogs which have a landing profile matching the profile of a specific one of the downhole landing and orienting joints so that when the landing-orientation tool is run downhole it will bypass landing and orienting joints having a non-matching internal landing profile and land within a landing and orienting joint having a profile matching the profile of the landing dogs. As the landing-orientation tool enters each of the landing and orienting joints of the casing string an orientation key of the tool will engage a helical guide ramp of a mule shoe within the landing and orienting joint and will be rotated by the guide ramp to a predetermined angular position for entry into an orientation slot of the mule shoe. If the tool has entered a landing and orienting joint of the casing string with a non-matching landing profile, the orientation key will be forced from the orientation slot as the tool continues its movement downhole. When the landing-orientation tool has entered a landing and orienting joint with an internal landing profile matching the landing configuration of the landing dogs with which the tool is equipped, the tool is capable of being locked with respect to the internal landing profile of the landing and orienting joint to enable the conduct of selected well operations, such as the milling of casing windows and reentry of lateral branches of wells. The landing-orientation tool is capable of being subsequently unlocked from the internal profile of the landing and orienting joint so that it may be retrieved from the well. When its removal from the landing and orienting joint is desired, the mechanism of the tool is responsive to a pulling force of a predetermined magnitude for unlocking the landing dogs from the internal landing profile of the casing nipple, thus releasing the tool for extraction from the casing. The tool is adaptable for landing within another one of the plurality of landing and orienting joints simply by changing out the landing dogs of the tool so as to provide landing dogs having a landing profile that matches the internal landing profile of a selected one of the casing nipples of the casing string.

The landing-orientation tool of this invention is particularly useful during the operation of building multilateral branches from a wellbore and for subsequent re-entry of multilateral well branches through the casing string. Though useful for the conduct of many differing downhole well activities, the principal function of the landing-orientation tool, as described herein, is the positioning, orienting and locking of casing window milling or deflection assemblies inside the landing and orienting joint. At least one and preferably a plurality of landing and orienting joints will be located downhole at selected depths and connected into the casing string as integral components thereof. The landing-orientation tool provides for precise location of a milling whipstock in case of window milling operations or a deflection whipstock in the case of a lateral re-entry operation.

The landing and orienting joint consists of the nipple body itself, having threaded ends for connection with sections of well casing and is provided internally with a mule shoe having helical guide surfaces for guiding an orientation key and thus rotating the landing-orientation tool until the key encounters a longitudinal orientation slot. There is provided a desired landing configuration profile on the inside of the landing and orienting joint body. The landing-orientation tool consists of a main body mandrel having a plurality of, typically three, landing dogs and an orientation key that project externally of the body mandrel for engagement with the matching internal profile of the landing and orienting joint that is defined by the landing nipple.

From the standpoint of operation, according to one possible method of operating the equipment, a casing string made up of landing and orienting joints stacked in line with conventional casing and casing joints is run into a wellbore, set and cemented. The number of landing and orienting joints and the position in the casing string of these joints is recorded during the casing string make-up. In each case, where several landing and orienting joints are to be stacked continuously, the angular reference of each must be recorded to facilitate subsequent branch wellbore construction, directional activities and subsequent re-entry. In the case of using adjustable orienting keys, each landing and orienting joint is adjusted in reference with a lower landing and orienting joint.

The casing string is run into the wellbore. Cementing of the annulus is preferably accomplished with a cementing string through the casing shoe or through the top of the annulus in order to avoid any cement contamination of the landing and orienting joints inside the casing. A directional survey can be performed, preferably by a wireline tool, to accurately locate the depth and orientation of one or more specific landing and orienting joints. The results of the survey may be used to preset the orienting key of the tool that supports the whipstock or any deflecting tool. A whipstock equipped with a landing-orientation tool at its bottom is set in place and a lateral window is cut in the casing, preferably by a milling operation. The bottom hole assembly may include a swivel joint which allows the landing-orientation tool to rotate when engaging the cam profile of the landing and orienting joint. Such rotation may also be achieved by using a positive displacement motor, or a turbine or other downhole motor in the bottom hole assembly attached to the landing-orientation tool. After a window has been opened in the casing section, a bottom hole drilling assembly drills the lateral branch employing any directional drilling technique suitable to the conditions that are desired for the lateral branch. The branch can be cased with a liner, if desired, or left open. After the branch wellbore has been completed, the whipstock is removed and other branches of the well can be built in the same way. A branch can be subsequently re-entered at a later date simply by placing a deflecting tool in the respective landing and orienting joint so that equipment being run through the casing will be deflected from the parent well casing, through the casing window and into the respective branch wellbore.

A completion mechanism such as a flow diverter, flow restricter, or artificial lifting device or other production means, can be permanently or temporarily installed in a landing and orienting joint without requiring any additional clamping system. A plug that isolates the lower portion of the parent well casing or a specific branch wellbore from the upper parent well can be permanently or temporarily installed in a landing and orienting joint without requiring any additional clamping system.

Thus, providing a parent well casing with landing and orienting joints in the manner discussed above provides simply and efficiently for a variety of well construction, servicing and operating techniques that require accurate depth and angular alignment of devices within the well casing. This system also permits a variety of well servicing activities to be conducted at various stages during the productive life of a well since landing and orienting joints are provided permanently in the well casing at its installation and are therefore available as casing references from which other downhole well activities may be designed and conducted.

BRIEF DESCRIPTION OF THE DRAWINGS

So that the manner in which the above recited features, advantages and objects of the present invention are attained can be understood in detail, a more particular description of the invention may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

Figure 1:
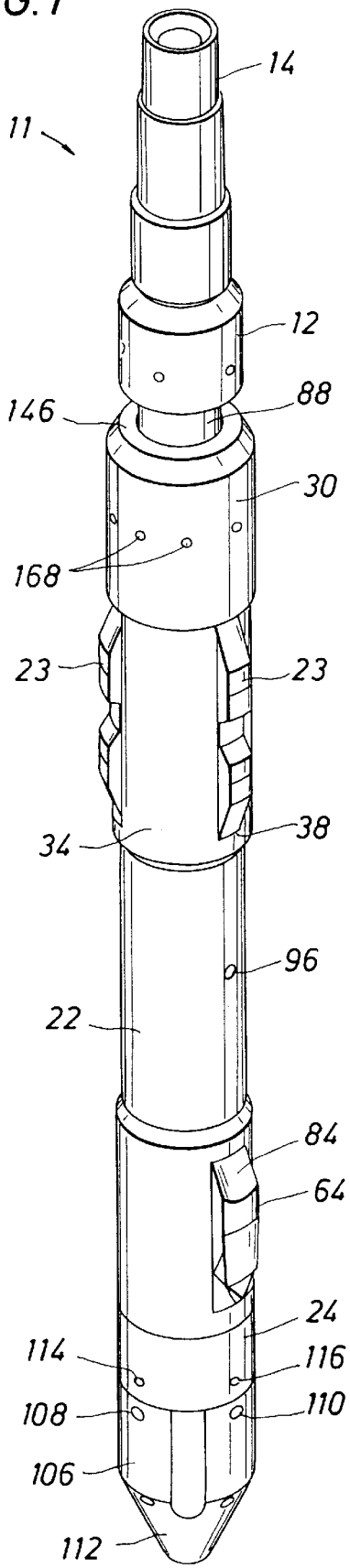
Figure 3:
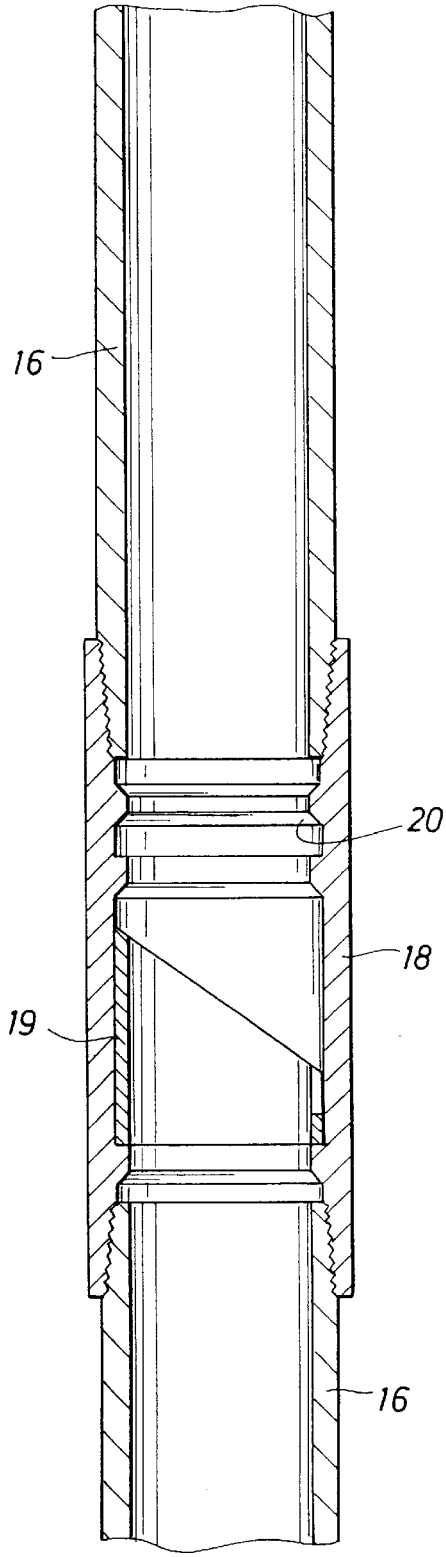
Figure 2A:
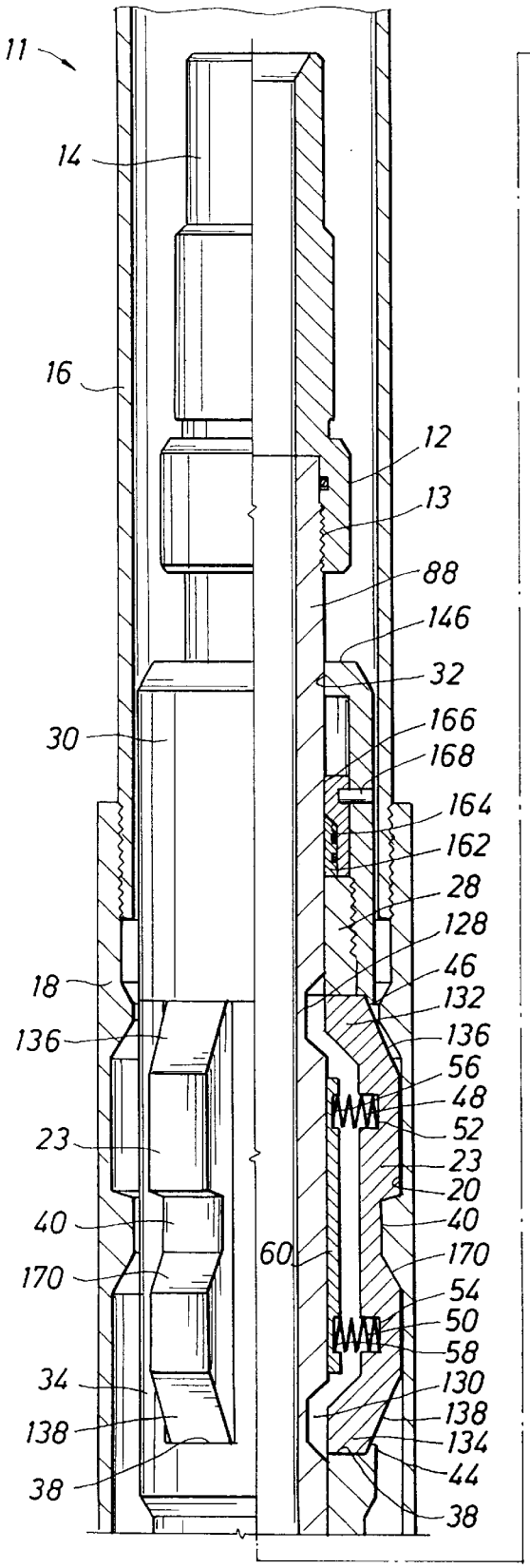
Figure 2B:
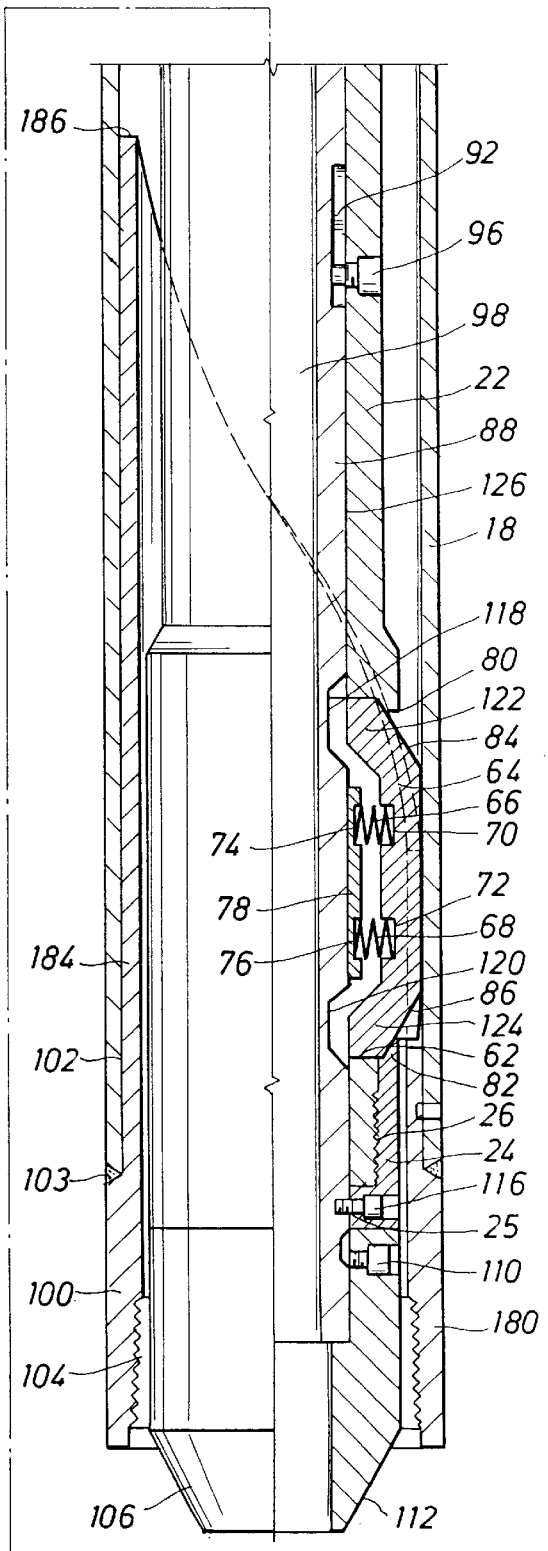
Figure 4:
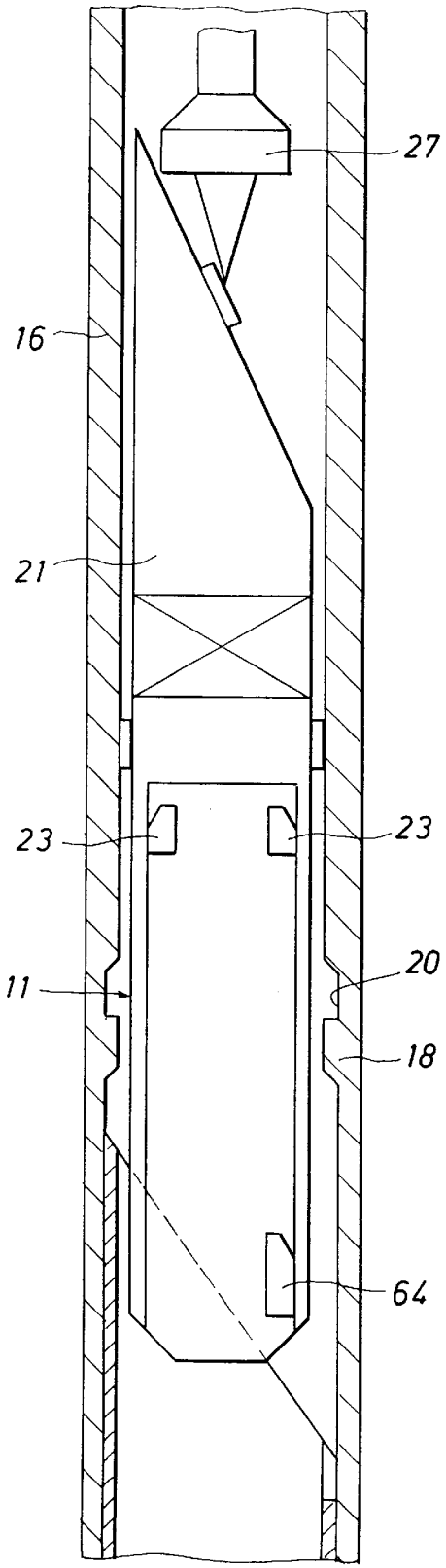
Figure 5:
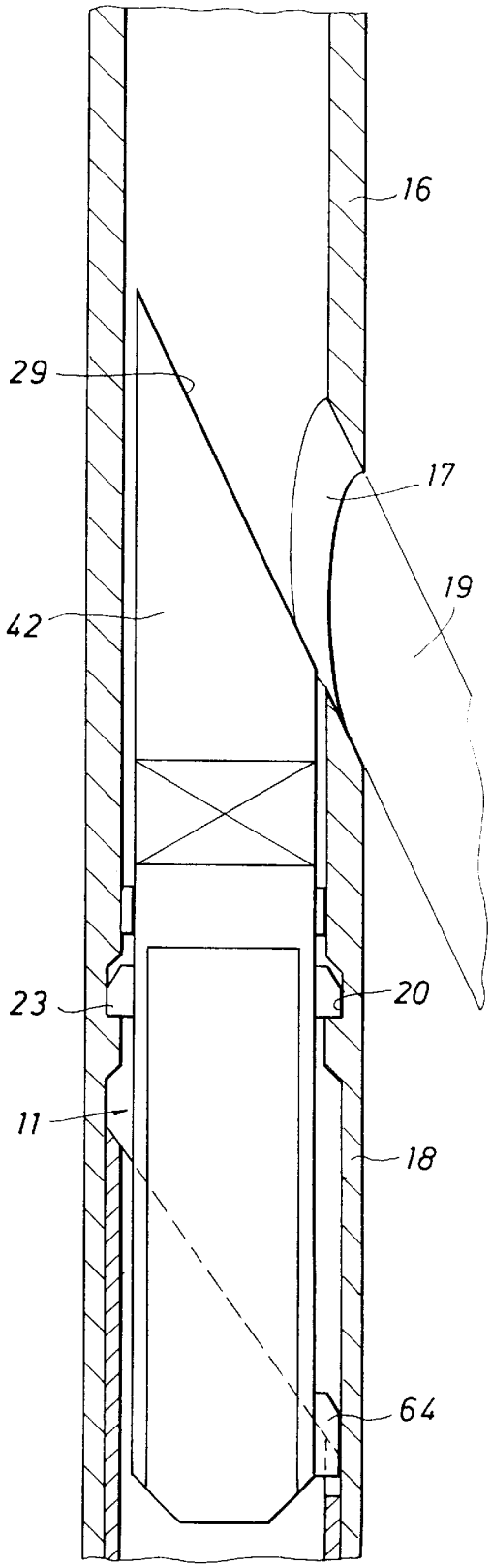
Figure 6:
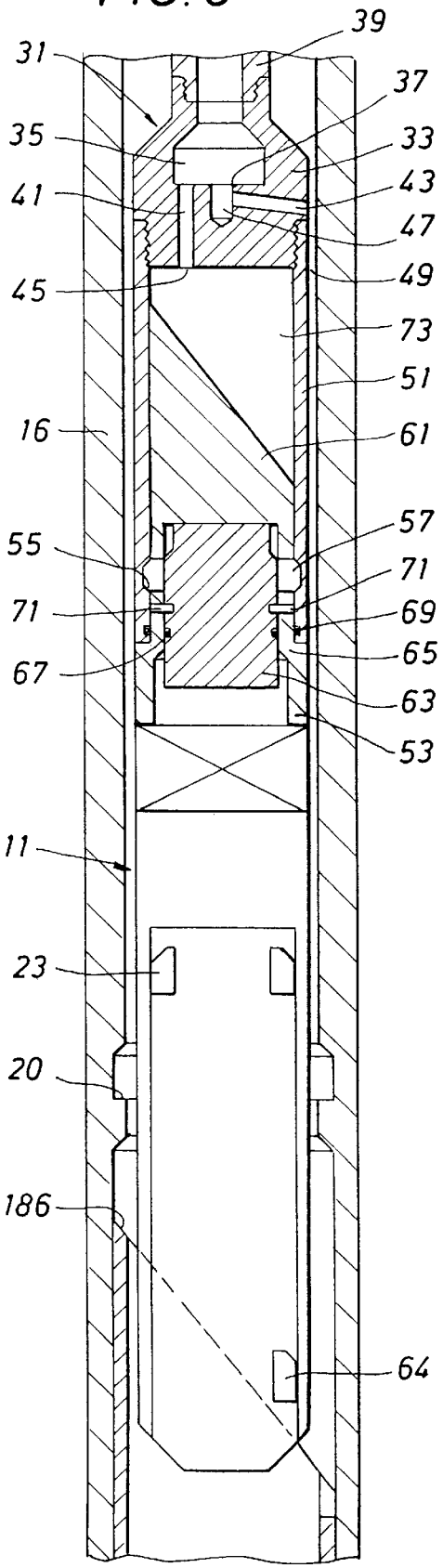
Figure 6A:
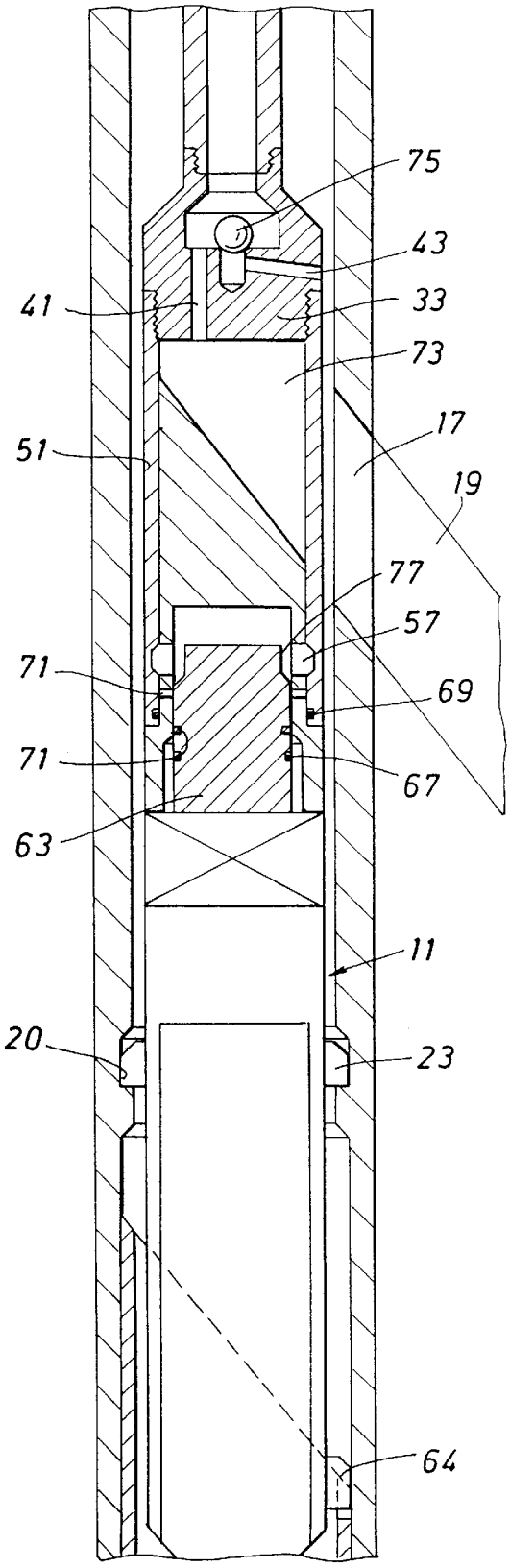

FIG. 1 is an elevational illustration of a landing-orientation tool constructed in accordance with the present invention shown in the running condition thereof and adapted with a set of profiled landing dogs for landing within a selected landing and orienting joint of a well casing wherein the landing and orienting joint is provided with a matching internal profile and further showing the external orientation key thereof;

FIG. 2A is a sectional illustration of a section of well casing showing the upper portion of a landing and orienting joint connected within the well casing, with the landing-orientation tool of FIG. 1 present therein and with the landing dogs of the landing-orientation tool being engaged with the matching internal profile of the landing and orienting joint;

FIG. 2B is a sectional view showing the lower portion of the landing and orienting joint of FIG. 2A and showing the lower portion of the landing-orientation tool located within the landing and orienting joint;

FIG. 3 is a partial sectional view of a well casing, schematically illustrating a landing and orienting joint according to the present invention being connected therein and having a mule shoe within the landing and orienting joint;

FIG. 4 is a schematic illustration according to the present invention showing a partial sectional view of a well casing and landing and orienting joint assembly defining an internal landing profile and showing a milling whipstock and casing window milling tool being positioned relative to a landing profile therein by a landing-orientation tool also embodying the teachings of the present invention, to which the milling whipstock is connected and showing the landing-orientation tool being in the running condition thereof and located with the landing dogs just above the internal landing profile of the well casing and landing and orienting joint assembly;

FIG. 5 is a partial sectional view similar to that of FIG. 4 and showing the landing-orientation tool in oriented and latched relation with the internal landing profile of the well casing and landing and orienting joint assembly and further showing a window in the well casing after milling thereof by a milling tool being guided by the milling whipstock as shown in FIG. 4;

FIG. 6 is a partial sectional view of a well casing and landing profile similar to that of FIGS. 4 and 5 and showing a running tool and landing-orientation tool being employed according to the present invention for positioning a deflection whipstock in lateral orienting and guiding position within the well casing prior to milling a casing window in the well casing or reentering a previously milled casing window;

FIG. 6A is a sectional view similar to that of FIG. 6 showing passage closure by a drop ball and pressure induced shearing of retainer screws and shifting of the lug locking piston to its lug release position.

Figure 7:
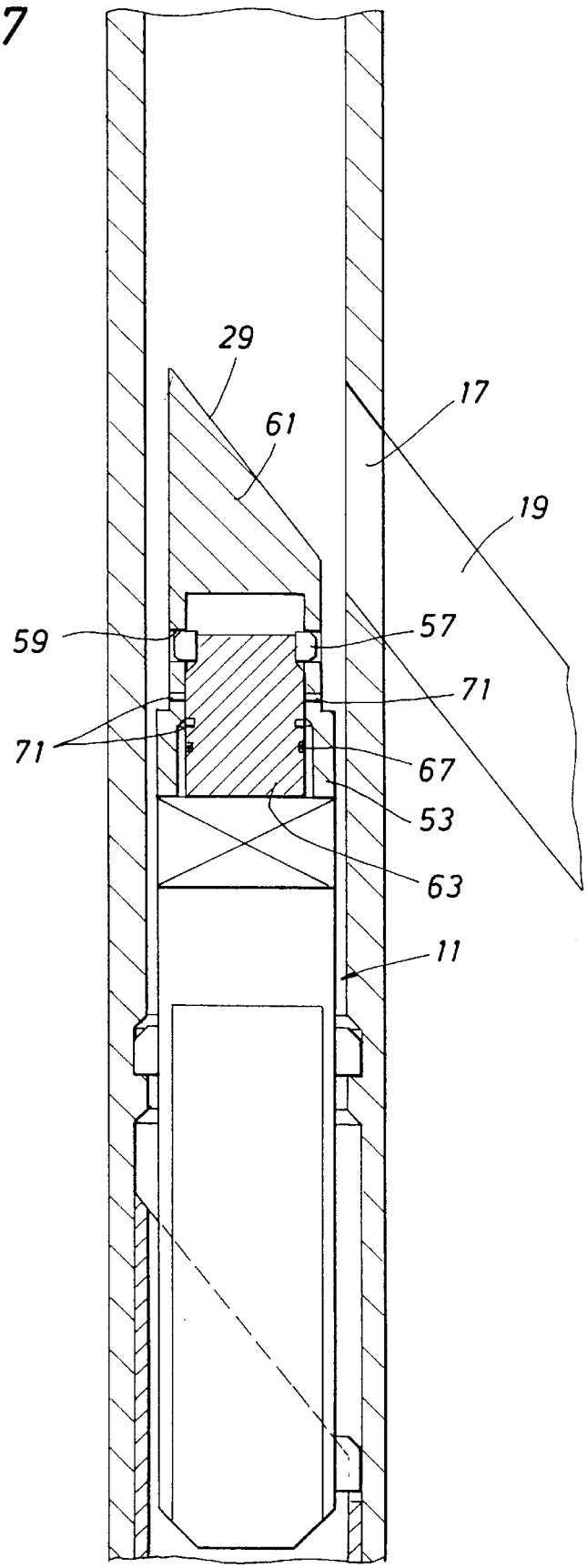
Figure 8:
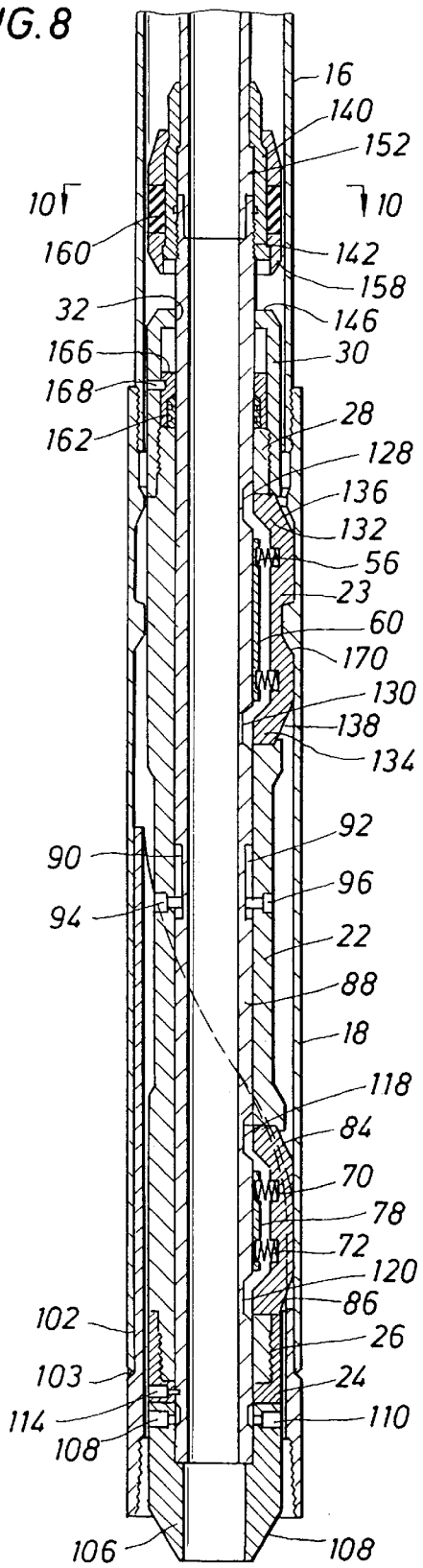
Figure 9:
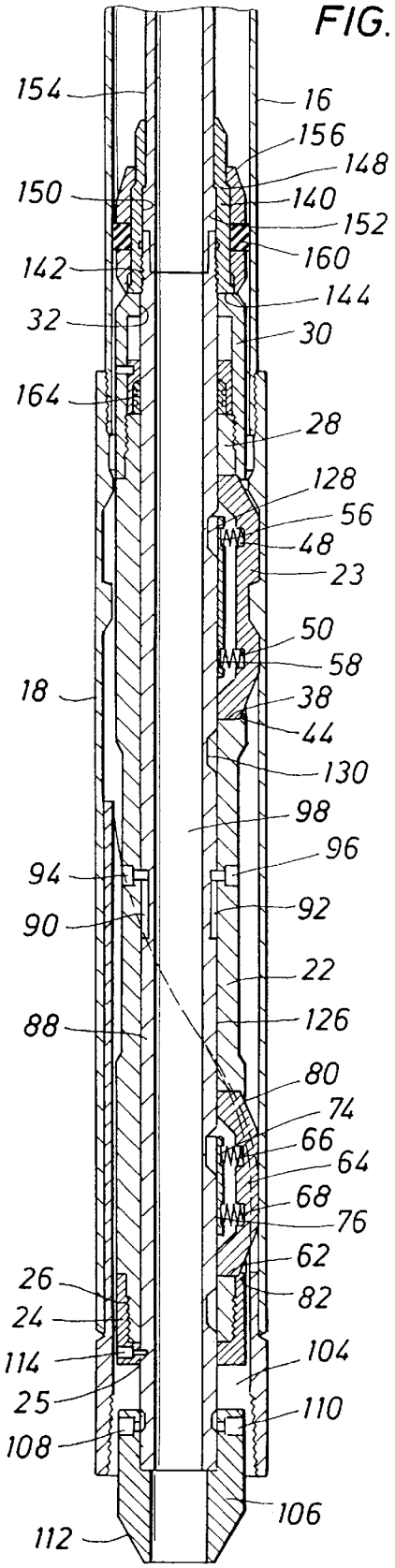
Figure 11:
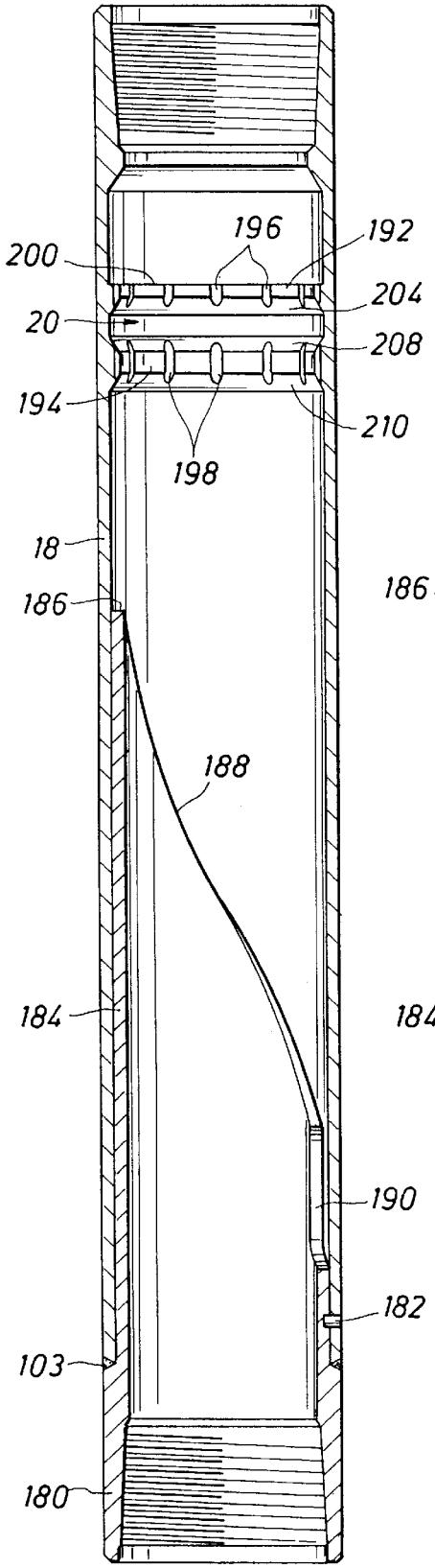
Figure 13:
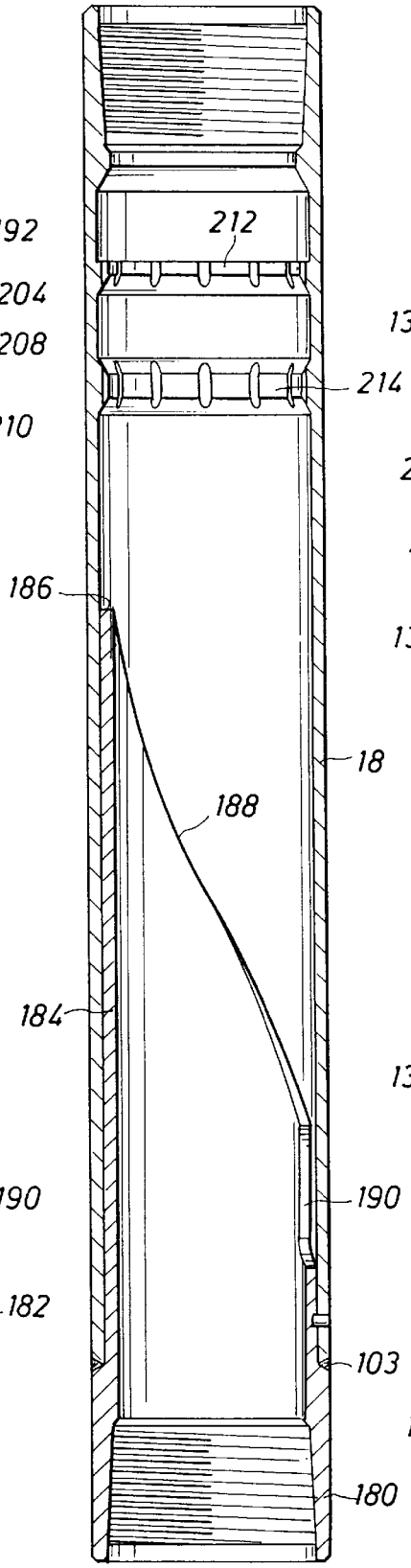
Figure 12:
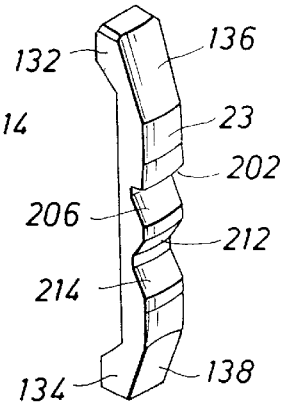
Figure 14:
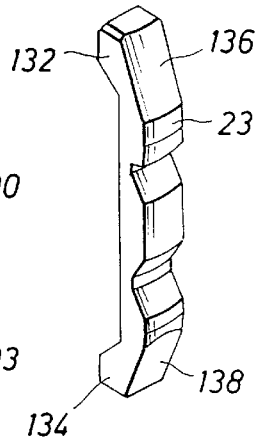

FIG. 7 is a partial sectional view of a well casing and landing profile similar to that of FIGS. 6 and 6A after unlocking and retraction of the running tool and showing the landing-orientation tool being latched within the internal landing profile of the casing nipple and positioning the guide surface of the deflection whipstock in orienting and guiding relation with a previously milled casing window such as for lateral well branch reentry;

FIG. 8 is a partial sectional view of a well casing having a landing and orienting joint connected therein which has an internal landing profile and a mule shoe and shows a landing-orientation tool of the present invention in the running condition with its landing dogs being engaged within the matching profile of the landing and orienting joint and the orientation key thereof positioned within the orientation slot of the mule shoe, but with the landing dogs and the orientation key in the unlocked conditions thereof;

FIG. 9 is a partial sectional view of a well casing and landing profile similar to that of FIG. 8 but showing the landing-orientation tool in the locked condition thereof with its landing dogs being locked within the internal profile of the landing and orienting joint and with the orientation key of the tool being locked within the orientation slot of the mule shoe;

FIG. 10 is a sectional view taken along line 10—10 of FIG. 8;

FIG. 11 is a sectional view of a landing and orienting joint constructed in accordance with the present invention and having therein a mule shoe and an internal landing profile of a predetermined configuration for the landing and latching of a landing-orientation tool having landing dogs of matching configuration therewith;

FIG. 12 is an isometric illustration of a landing dog designed for matching interfitting relation with the internal landing profile of the landing and orienting joint of FIG. 11;

FIG. 13 is a sectional view of a landing and orienting joint for connection within a casing string and having a selected internal landing profile differing from the landing profile of the landing and orienting joint of FIG. 11 and also having an internal mule shoe for orientation of a landing-orientation tool therein;

FIG. 14 is an isometric illustration of a landing dog designed for matching interfitting relation with the internal landing profile of the landing and orienting joint of FIG. 13;

FIG. 15 is a sectional view of a landing and orienting joint for connection within a casing string and having a selected internal landing profile differing from the landing profiles of the landing and orienting joints of FIGS. 11 and 13 and also having an internal mule shoe for orientation of a landing-orientation tool therein, and with the angle of the guide ramps of the mule shoe being identified;

FIG. 16 is an isometric illustration of a landing dog designed for matching interfitting relation with the internal landing profile of the landing and orienting joint of FIG. 15;

FIG. 17 is a sectional view taken along line 17—17 of FIG. 15; and FIG. 18 is an isometric illustration of an orientation key for assembly with the landing-orientation tool of FIGS. 1 and 2B and adapted for orientation of the landing-orientation tool with respect to each of the landing and orienting joints of FIGS. 11, 13 and 15.

DESCRIPTION OF THE PREFERRED EMBODIMENT

Referring now to the drawings and first to FIGS. 1, 2A and 2B, a landing-orientation tool embodying the principles of the present invention is illustrated generally at 11 and is provided at its upper end with a top coupling 12 which is adapted at 14 for connection with a running tool, shown in FIGS. 6 and 6A, for the purpose of running the landing-orientation tool through a well casing 16 shown in FIG. 2A. As another aspect of the present invention, the well casing 16 is provided with a landing and orienting joint 18 having its upper and lower ends in threaded connection with sections of the well casing 16 so that the landing and orienting joint 18 becomes an integral component of the casing string of the well. The landing and orienting joint 18, according to the present invention, is provided with a particular internal landing profile 20 which is adapted to be engaged by a plurality of landing dogs 23, each having a matching profile with respect to the internal landing profile of the landing and orienting joint.

As shown particularly in FIGS. 2A and 2B, and as shown in FIGS. 8 and 9, the landing-orientation tool 11 defines a main body mandrel 22 of elongate, tubular configuration and having at its lower end a bottom cap 24 which is connected thereto by a threaded connection 26. At its upper end the main body mandrel 22 is provided with an externally threaded section 28 to which is connected a top cap 30 defining a central aperture 32. The main body mandrel 22 defines a tubular locking section 34 having therein a plurality of lock windows such as shown at 38, being spaced equally about the locking section 34. A plurality of landing dogs 23 are replaceably installed in assembly within the tool and are positioned with portions thereof extending through lock windows 38 so that the external profile 40 of each landing dog 23 will be exposed externally of the locking section 34 and thus positioned for locking engagement with the internal landing profile 20 of a matching one of the landing and orienting joints 18. As explained in detail below, each of the plurality of landing and orienting joints 18 that is employed in the well casing 16 will have a different internal profile and thus will be operatively engaged by the landing dogs of a landing-orientation tool being run only under circumstances where the landing dogs have a matching profile with the internal profile of a particular landing and orienting joint. This feature of the invention will become more apparent upon review of the detailed discussion below concerning FIGS. 10–15.

The main body mandrel wall at the locking section 34 defines a shoulder projection 44 at each of the lock openings 38 which extends beyond the lower end of the lock opening and thereby provides a restraint shoulder to restrain outward movement of the landing dogs 23. Thus each of the landing dogs 23 can move radially outwardly only to the extent permitted by the shoulder projection 44. The upper end of each of the landing dogs 23 is restrained in the same manner by the lower end 46 of the top cap 30 which extends beyond the upper end of the lock window and thus provides for restraint of the upper ends of the landing dogs 23. Each of the landing dogs 23 however can move radially inwardly from the position shown in FIGS. 2A, 8 and 9 for example, to enable the landing dogs to clear internal objects within the well casing, including clearance of an internal landing and orienting joint profile of a casing nipple that does not match the profile of the landing dogs. A pair of compression springs 48 and 50 is provided for each of the landing dogs, with respective ends 52 and 54 thereof being located within respective spring receptacles thereof. The inner ends 56 and 58 of each of the compression springs 48 and 50 are received within spring recesses of respective spring reaction plates 60 that are provided for each of the landing dogs 23.

At its lower end the main body mandrel 22 defines an orienting window 62 within which is moveably positioned an orienting key 64 being urged radially outwardly by a pair of compression springs 66 and 68. The outer ends 70 and 72 of the compression springs are located within spring receptacles of the orienting key 64 with the inner ends 74 and 76 thereof being located within spring receptacles of a spring reaction plate 78. The orienting key 64 is restrained at its upper end by a restraint projection 80 of the main body mandrel 22 that overlies an upper portion of the orienting window 62 and is restrained at its lower end by the upper end portion 82 of the bottom cap 24. In the absence of other forces, the compression springs 66 and 68 maintain the orienting key 64 projected radially outwardly to the maximum extent permitted by restraint projections 80 and 82 as shown in FIG. 2B. In the event obstructions such as casing joints, landing and orienting joint profiles, casing windows and the like are encountered during running of the tool, the orienting key 64 will contact these obstructions and be moved radially inwardly thereby against the compression of the springs 66 and 68, to allow the orienting key 64 to clear the obstructions as the tool moves within the casing string. To further assist the obstruction clearing capability of the orienting key 64, the upper and lower ends 84 and 86 of the orienting key 64 are of tapered configuration thereby providing a cam-like activity during movement of the tool relative to a internal obstruction of the casing so that the internal obstruction develops a force that yields the orienting key 64 radially inwardly against the compression of the springs 66 and 68 so that it will pass over the obstruction and prevent the tool from hanging up.

The landing-orientation tool 11 is provided with an elongate inner mandrel 88 having the upper end thereof extending through the central aperture 32 of the main body mandrel 22 and the lower end thereof extending through the aperture 25 defined by the bottom cap 24. The inner mandrel 88 is linearly movable within the main body mandrel 22 within limits defined by a pair of guide slots 90 and 92 which are engaged by the inner portions of a pair of guide screws 94 and 96 that are threadedly received within guide screw receptacles of the main body mandrel 22. The inner mandrel 88 is of tubular configuration, defining a central flow passage 98 through which fluid is allowed to flow.

At its lower end, the landing and orienting joint 18 is provided with a mule shoe sub 100 having welded connection at 102 with the lower end of the landing and orienting joint body and providing a "curved guide geometry" located internally of the casing nipple and known in the trade as a "mule shoe", which serves the purpose of rotatably orienting an object moving downwardly into the landing and orienting joint. Typically, the mule shoe will be in welded assembly within the casing nipple by a circumferential weld bead 103, though it may be in threaded connection if desired or may be connected to the casing nipple by any other suitable means. The lower end of the mule shoe sub 100 is internally threaded for connection to a section of the well casing 16 and extends sufficiently beyond the lower end of the bottom cap 24 to define an internal receptacle 104 to receive a nose member 106 that is secured to the lower end of the inner mandrel 88 by locking screws 108 and 10. The lower end of the nose member 106 is tapered as shown at 112 to provide for guiding the landing-orientation tool 11 as it is run downwardly through the casing string and into the intended landing and orienting joint 18. The nose member 106 may be secured to the lower end of the inner mandrel 88 by any other suitable means without departing from the spirit and scope of the present invention. The inner mandrel 88 is movable between a running position as shown in FIG. 8 and a locked position as shown in FIG. 9. In its running condition the nose member 106 is retained in substantial abutment with the lower end of the bottom cap 24 by means of a plurality of running shear screws 114 and 116 16 which are secured within appropriate receptacles of the bottom cap 24 and have inner shear elements that project into registering receptacles defined in the lower end of the inner mandrel 88 as shown in FIGS. 2B and 8. In the locking position of the inner mandrel 88, as shown in FIG. 9, sufficient downward force will have been applied to the inner mandrel 88 to shear the running shear screws 114 and 116 and thereby permit downward movement of the inner mandrel 88 from the running position shown in FIG. 8 to the locking position shown in FIG. 9.

The inner mandrel 88 defines a pair of spaced receptacles 118 and 120, each having tapered upper and lower walls and being adapted to receive respective end portions 122 and 124 of the orienting key 64 when the inner mandrel 88 is in the running position relative to the main body mandrel 22 as shown in FIG. 8. In this position, the orienting key 64 is capable of being moved radially inwardly against the compression of its springs 66 and 68 in the event an object is encountered during running of the tool through the casing string. When the inner mandrel 88 has been moved downwardly to the position shown in FIG. 9, upon shearing of the running shear screws 114 and 116, the receptacles 118 and 120 will be positioned out of registry with the appropriate end portions 122 and 124 of the orienting key 64 as shown in FIG. 9 so that the upper and lower ends of the orienting key 64 will be restrained from radially inward movement by the outer cylindrical surface 126 of the inner mandrel 88 and thus locked at the maximum radial extent thereof. Of course, the orienting key 64 in the position shown in FIG. 9 will be located within the bottom portion of an orienting slot defined by the mule shoe so that the landing-orientation tool 11 will be rotationally oriented relative to the casing 16. This feature will be described in greater detail below in connection with the detailed description of the mule shoe and the relationship of the landing-orientation tool 11 with the mule shoe as the tool is run to its landing position within the selected landing and orienting joint 18.

An intermediate portion of the inner mandrel 88 defines receptacles for receiving respective upper and lower end portions of each of the landing dogs 23, when the landing-orientation tool 11 is in its running condition as shown in FIG. 8. As shown, the inner mandrel 88 defines upper and lower tapered wall receptacles 128 and 130 which are adapted to receive the respective offset ends 132 and 134 of the associated landing dog 23 when the receptacles are positioned relative to the main body mandrel 22 in the running condition of the tool as shown in FIG. 8. Thus, when the respective inclined ends 136 or 138 of the landing dogs 23 encounter any object within the well casing during the tool running operation, the inclined leading ends of the landing dogs 23 will cause the dogs to be moved radially inwardly against the force of the compression springs 48 and 50 and thus will allow the landing dogs 23 to pass over the object without causing the tool to become hung on the object. As soon as the obstruction is passed and the radially inward force on the landing dogs 23 is dissipated, then the compression springs 48 and 50 will again move the landing dogs 23 radially outwardly to the maximum limit that is permitted by the restraining elements 44 and 46. Thus, when the tool is being moved through a landing and orienting joint of the casing string, if the internal profile of the landing and orienting joint is not matched by the external profile of the landing dogs, the landing dogs will simply be yielded radially inwardly and will not seat within the profile of the landing and orienting joint. When this condition occurs, the tool will simply be moved through the landing and orienting joint and will continue moving down the casing string until a landing and orienting joint is entered having a matching profile with the profile of the landing dogs. When a landing and orienting joint having a matching internal landing profile is encountered, the compression springs 48 and 50 will move the landing dogs 23 radially outwardly to their maximum extent thereby fully engaging the landing dogs 23 with the matching internal profile of the landing and orienting joint 18 as shown in FIGS. 8 and 9. When a casing nipple having a matching landing profile is encountered, the landing dogs 23 will seat within the matching profile and resist further downward movement of the tool. After the landing-orientation tool has been seated in this manner, when a sufficient downward force is then applied to the landing-orientation tool by a running tool the running shear screws 114 and 116 will be sheared. Upon shearing of the running shear screws 114 and 116, the inner mandrel 88 will move downwardly to the locked position shown in FIG. 9 thereby causing the tapered wall receptacles 128 and 130 of the inner mandrel 88 to move downwardly to a position misaligning the receptacles with respect to the offset ends 132 and 134 of the landing dogs 23. This causes the offset ends of the landing dogs to be supported against radially inward movement by the outer cylindrical surface 126 of inner mandrel 88 as shown in FIG. 9. In this condition of the tool, the landing dogs 23 will be locked in securely interengaged relation with the matching internal landing profile of the landing and orienting joint 18.

The top coupling 12 may be of the configuration shown in FIG. 2A and may be connected to the upper end of the inner mandrel 88 by means of threaded connection 13. In the alternative, as shown in FIGS. 8, 9 and 10, the top coupling may be of the configuration as shown at 140, being connected to the upper end of the inner mandrel 88 by a threaded connection 142 and having a lower circular abutment 144 disposed for abutting contact with the upper end 146 of the top cap 30. The intermediate portion of the top coupling 140 is offset at 148 defining an inner receptacle 150 for receiving the enlarged lower diameter portion 152 of a running or retrieving tool 154. Thus, the top coupling 140, secures the lower end of the running or retrieving tool 154 to the inner mandrel 88 and permits the inner mandrel to be manipulated upwardly or downwardly or the tool run through the casing depending upon the configuration of the landing and orienting joint being encountered by the tool.

It may be desired to provide the tool with a sealing or packing capability within the casing. To accomplish this purpose, a packer 156 is arranged about the top coupling 140 with a lower circular section 158 thereof normally extending below the lower end of the top coupling 140 as shown in FIG. 8. When the main body mandrel 22 has been stopped within the landing and orienting joint 18 by the landing dogs 23 engaging the matching internal landing profile thereof, the inner mandrel 88 is moved downwardly to lock the main body mandrel 22 into the landing and orienting joint 18. At the final portion of this downward movement, the lower end of the lower circular section 158 of the packer 156 will contact the upper end 146 of the top cap 30. Further downward movement of the inner mandrel will bring the lower end of the top coupling 140 into abutting engagement with the upper end of the top cap 30 and will cause compression of a packer seal 160 deforming the packer seal to the condition shown in FIG. 9 and causing sufficient radial expansion of the packer seal to cause its sealing engagement with the internal wall surface of the casing 16 immediately above the landing and orienting joint. Conversely, the packer seal 160 will return to its original, non-sealing condition as shown in FIG. 8 upon upward movement of the running or retrieving tool 154.

Within the top cap 30, there is provided a plurality of ratchet segments 162 as shown in FIG. 2A which are disposed about the outer cylindrical surface of the inner mandrel 88 and, upon upward movement of the inner mandrel 88 are driven into restraining engagement with the inner mandrel 88 by a tapered internal surface 164 of a ratchet retainer 166. The ratchet retainer 166 is secured within the top cap 30 by means of a plurality of releasing shear screws 168 which are received within appropriate receptacles in the top cap 30 and have inner shear extremities engaging within appropriate recesses of the ratchet retainer 166. When the releasing shear screws 168 have been sheared by sufficient upward force on the inner mandrel 88 by the running or retrieving tool, the ratchet segments 162 will release their gripping relation with the outer surface of the inner mandrel 88 and thus permit the inner mandrel to be moved upwardly relative to the main body mandrel 22 until the offset end portions of the landing dogs 23 can be moved into the receptacles 128 and 130 of the inner mandrel 88. In this condition, upward force on the landing dogs 23 causes a cam-like reaction to take place at the matching inclined surfaces 170 thus causing the landing dogs to be moved radially inwardly to the unlocking positions thereof. When this has occurred, the landing-orientation tool 11 may be moved upwardly for retrieval from the well casing.

FIGS. 3–7 are essentially schematic illustrations of various aspects of the present invention. For structural details however, the structure of the mechanism shown in FIGS. 1–2B, 8 and 9 should be considered. The running tool for installation of the landing-orientation tool 11 is shown in FIGS. 6, 6A and 7. In FIG. 3, a well casing 16 and landing and orienting joint 18 are shown in threaded connection. FIG. 4 shows a landing-orientation tool 11 according to the present invention being run into the casing 16 and supporting a milling whipstock 21 having window milling apparatus 27 for casing milling operations. The landing-orientation tool 11 is shown with its landing dogs 23 retracted and being in disengaged relation with the internal profile of the casing 16 or landing and orienting joint 18 as the case may be. The drill string supporting the window milling apparatus 27 may include a swivel joint which allows the landing-orientation tool 11 and the apparatus which it carries to freely rotate in both the clockwise and counter-clockwise directions when engaging the cam profiles of the landing and orienting joints 18. This feature allows the landing-orientation tool 11 to pass through multiple landing and orienting joints without inducing torque in the drill string and bottom hole assembly. Alternatively, a positive displacement motor, or a turbine or other downhole motor may provide for the desired rotation. As shown in FIG. 5, the landing-orientation tool 11 of the present invention is shown with its landing dogs 23 engaged and locked with respect to the internal landing profile 20 of the casing or casing nipple and with the orientation key 64 thereof in received relation within the positioning groove defined by the internal mule shoe of the casing nipple. As shown in FIG. 5, element 42 can be a deflection whipstock having a tapered deflection surface 29 which enables apparatus being run through the casing string to be deflected through the lateral opening 17 of the well casing 16 so as to traverse the lateral branch wellbore 19 for appropriate well operations.

According to the schematic illustration of FIG. 6, the landing-orientation tool 11 is shown with its landing dogs 23 retracted for running activities and depicting a running tool, shown generally at 31, being releasably connected to a deflection whipstock 61 for landing the tool 11 in the landing profile as shown in FIG. 6A. After tool landing has been accomplished, the running tool 31 can be disconnected from the deflection whipstock 61 and retracted from the well, thereby leaving the deflection whipstock 61 or milling whipstock as the case may be, firmly seated, oriented and locked within the well casing so that the inclined surface 29 thereof is appropriately oriented relative to the lateral opening 17 for deflecting a drilling or well servicing string through the lateral opening 17 and into the lateral branch wellbore 19.

In the embodiment shown in FIGS. 6 and 6A, a running tool shown generally at 31 is provided with a connection sub 33 defining an internal fluid passage 35 and an internal circular seat 37. At its upper end, the connection sub 33 is adapted for connection to a running string 39. From the fluid passage 35 extends flow passages 41 and 43 with passage 41 terminating at an outlet 45 at the bottom of the connection sub 33 and with passage 43 intersecting a recess 47 below the seat 37 and opening to the annulus 49 between the casing 16 and the connection sub 33. A top sleeve 51 is provided with its upper end being threadedly connected to the connection sub 33 and with its lower end adapted for releasable locking connection with a latching section 53 of the deflection whipstock 61 which is located at and connected to the upper end portion of the landing-orientation tool 11. The top sleeve 51 defines lug recesses 55 within which latching lugs 57 are receivable to latch the top sleeve 51 to the deflection whipstock 61. The latching lugs 57 are carried within latch openings 59 of the deflection whipstock 61 and, in the latched condition shown in FIG. 6, are supported against releasing movement by a latch piston 63. The latch piston 63 is normally sealed within the upper, reduced diameter end 65 of the latching section 53 by an O-ring seal 67 which is retained within a circular O-ring groove of the piston. The lower end of the top sleeve 51 is received about the upper, reduced diameter end 65 of the latching section 53 and is sealed therewith by an O-ring seal 69. The latch piston 63, in the running condition shown in FIG. 6, is fixed within the upper, reduced diameter end 65 of the latching section 53 by a plurality of shear pins or screws 71 and is movable downwardly to the latch release position shown in FIG. 6A upon shearing of the pins or screws 71 as shown.

Force for shearing of the pins or screws 71 is developed on the latch piston 63 by fluid pressure entering the chamber 73 within which the deflection whipstock 61 is located from the internal fluid passage 35 via the passage 41. Since the deflection whipstock 61 is not sealed to the top sleeve 51, the fluid pressure in chamber 73 will act on the surface area of the latch piston 63 being defined by the O-ring seal 67. To develop fluid pressure acting on the piston 63, a ball 75 is dropped through the flow passage of the running string 39 and becomes seated on the circular seat 37, thus blocking the flow passage 43 to the annulus 49. When fluid pressure is then built up in the chamber 73, it acts on the piston 63 and develops a downward releasing force on the piston. When this downward force is sufficient to shear the pins or screws 71, the piston 63 will be driven downwardly to the position shown in FIG. 6A thus positioning an upper piston recess 77 in registry with the latching lugs 57, and permitting movement of the latching lugs to the release positions thereof as shown in FIG. 7. When the latching lugs 57 are released, application of an upward force on the running string 39 will cause the internal tapered surfaces of the latching recess 55 to drive the latching lugs 57 radially inward to the release positions thereof. The upward force being applied to the running string 39 will, in addition, withdraw the top sleeve 51 from its position about the upper end of the deflection whipstock 61, thus leaving the downhole landing-orientation tool 11 latched to the internal profile of the landing and orienting joint and with the inclined surface 29 of the deflection whipstock 61 properly oriented from the standpoint of depth and angular positioning for directing milling of the lateral opening 17 and drilling of the lateral branch wellbore 19 as well as providing for simple and efficient reentry of the lateral branch wellbore.

As shown in greater in detail in FIGS. 11, 13 and 14, a mule shoe sub 180 is shown to be connected to the lower end of the casing nipple and aligned therewith by means of an alignment pin 182. The mule shoe sub 180 defines an elongate tubular "mule shoe" section 184 having a pointed upper end 186 and defining a pair of curved, generally helical guide edges 188 having the lower ends thereof intersecting an internal alignment slot 190 which is adapted to receive the orienting key 64 of the landing-orientation tool.

As shown at the upper end of the landing and orienting joint 18 of FIG. 11, the landing and orienting joint is provided with a specifically designed internal landing profile, shown generally at 20, having a pair of spaced circular inwardly projecting ribs 192 and 194 having vertically oriented slots therein as shown at 196 and 198. The upper circular rib 192 defines an abrupt shoulder 200 which, when landed, is engaged by a matching, abrupt, downwardly facing profile shoulder 202 of the matching landing dog 23 shown in FIG. 12. A tapered, downwardly facing circular shoulder 204 is adapted for engagement with matching inclined shoulder surface 206 of the landing dog 23 of FIG. 12. The lower circular rib 194 of the landing profile 20 defines oppositely tapered inclined shoulders 208 and 210 that arc engaged respectively by matching inclined shoulders 212 and 214 of the matching landing dog 23. During decent or ascent of the landing-orientation tool within the well casing, if a landing and orienting joint 18 having an internal landing profile that is not matched by the landing profile of the landing dogs of the tool is encountered, the inclined, lower guide surface 138 of the landing dogs 23 will simply guide the landing dogs through the non-matching landing profile so that no seating will occur. The landing dogs 23 will simply be urged radially inwardly against the compression of their compression springs 48 and 50 to allow passage of the landing-orientation tool through the landing and orienting joint.

As shown in FIG. 13, a landing and orienting joint 18 is shown which is in most respects identical to the landing and orienting joint shown in FIG. 11. The difference is that internally projecting circular ribs 212 and 214 are provided, having differing vertical spacing as compared to the vertical spacing of the circular ribs 192 and 194 of FIG. 11. In FIG. 14 there is shown a landing dog 23 which matches the internal landing profile of the landing and orienting joint of FIG. 13. Thus, a landing-orientation tool provided with landing dogs of the profile shown in FIG. 14 will readily pass through the internal landing profile of the landing and orienting joint of FIG. 11 but will readily land on and become seated in engagement with the internal landing profile of the landing and orienting joint of FIG. 13. The landing-orientation tools may be adapted for landing within a particular one of a plurality of landing and orienting joints provided in a casing string simply by providing the tool with landing dogs of the specific matching profile for landing on the internal landing profile of the selected landing and orienting joint.

The landing and orienting joint 18 shown in FIG. 15 is different from the landing and orienting joints of FIGS. 11 and 13 only in that an internal landing profile is provided which is defined by a circular, inwardly projecting rib 216 having vertically oriented slots therethrough as shown at 218. The rib 216 defines an abrupt upwardly facing landing shoulder 220 and an downwardly facing inclined guide shoulder 222. Its corresponding landing dog 23 is shown in FIG. 16. The landing dogs of FIGS. 12, 14, and 16 are substantially identical with the exception of the particular external landing profile thereof. The landing dog of FIG. 16 defines a downwardly facing abrupt landing shoulder 224 which is adapted to seat on the upwardly facing landing shoulder 220 of the circular rib 216 and to seat on an upwardly facing inclined shoulder 226 which matches the downwardly facing inclined guide 222 of the internal landing profile of the landing and orienting joint.

An important aspect of the present invention is presented by the configuration of the orienting key 64 shown in FIG. 18. The lower portion of the orienting key 64 defines an inclined surface 86 which performs a cam-like function to force the orienting key into its matching receptacles 118 and 120 in the event an internal obstruction is encountered. Additionally, the lower portion of the orienting key 64 defines a pair of oppositely inclined surfaces 228 and 230 which intersect at a point 232. The inclined surfaces 228 and 230 have matching inclination with the angle of curvature 234 of the mule shoe guide edges 188. Thus, as the landing-orientation tool is moved downwardly, the point 232 will bypass the pointed upper end 186 of the mule shoe 184 and thus one or the other of the inclined guide surfaces 228 and 230 of the orientation key 64 will come into guiding contact with a respective helical guide edge 188. Since the surfaces 228 or 230 will be in surface-to-surface contact with the respective guide edges of the mule shoe, there will be little tendency to cause structural deformation or excessive wear of the mule shoe ramp surfaces during downward movement of the landing-orientation tool. Thus, the orienting key will establish essentially a bearing function as well as a guiding function to ensure against excessive wear or structural deformation of the guide ramp surface of the landing and orienting joint.

In view of the foregoing it is evident that the present invention is well adapted to attain all of the objects and features set forth above, together with other objects and features which are inherent in the apparatus disclosed herein.

As will be readily apparent to those skilled in the art, the present invention may be produced in other specific forms without departing from its essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A method for selective positioning, orienting and locking objects at predetermined depths within a well casing, comprising:

(a) providing within a well casing a plurality of landing and orienting joints each being located at a desired well depth and each defining an internal landing profile therein differing from the internal landing profiles of the other landing and orienting joints and each having a mule shoe therein for tool orientation during running movement within the well casing, said mule shoe having an upper end, an orientation slot, and a pair of generally helical guide ramps extending from said upper end to said orientation slot;

(b) running into the well casing a landing-orientation tool having in assembly therewith at least one landing dog having a matching profile with the profile of a selected one of said plurality of landing and orienting joints, the landing-orientation tool further having an orientation key for orienting engagement with one of the helical guide ramps of the mule shoe of the landing and orienting joint being entered for rotating said landing-orientation tool to a predetermined angular position in registry with said orientation slot; and (c) during said running of said landing-orientation tool, passing said landing-orientation tool through landing and orienting joints not having a matching internal landing profile and landing said landing-orientation tool within a landing and orienting joint having a matching profile.

2. The method of claim 1, further comprising:

(d) upon engagement of said at least one landing dog of said landing-orientation tool within a landing and orienting joint having a matching profile, locking said landing-orientation tool within said landing and orienting joint.

3. The method of claim 2, further comprising:

(e) unlocking said landing-orientation tool from said landing and orienting joint; and (f) retrieving said landing-orientation tool from said well casing.

4. The method of claim 1 wherein said landing-orientation tool is run into the well casing while suspended from an apparatus providing for bi-directional rotation of said landing-orientation tool.

5. The method of claim 1, wherein the orientation key defining oppositely angulated guide surfaces for selective guiding engagement with the surfaces of said helical guide ramps, said method further comprising:

traversing a guide surface of said orientation key along a helical guide ramp surface of said mule shoe during downward movement of said landing-orientation tool within each of said landing and orienting joints for rotating said landing-orientation tool to position said orientation key in registry with said orientation slot.

6. The method of claim 5, wherein said helical guide ramps of said mule shoe and said guide surfaces of said orientation key are of matching angular relation, said method further comprising:

(a) establishing surface-to-surface bearing and guiding relation of a guide surface of said orientation key with a helical guide ramp surface of said mule shoe; and (b) maintaining said surface-to-surface bearing and guiding relation during movement of said orientation key along said helical guide ramp.

7. The method of claim 1, wherein said landing-orientation tool having an outer tubular body mandrel through which said at least one landing dog and said orientation key project and an inner tubular actuator mandrel located within said outer tubular body mandrel and being linearly movable relative to said outer tubular body mandrel between a running position where said at least one landing dog and orientation key are unlocked and a locking position where said at least one landing dog and orientation key are locked, further comprising:

(a) securing said inner tubular actuator mandrel in a running position where said at least one landing dog and said orientation key are unlocked;

(b) after landing of said at least one landing dog within a landing and orienting joint having a matching profile, moving said inner tubular actuator to said locking position for locking said at least one landing dog within said matching profile of said landing and orienting joint and locking said orientation key within said orientation slot; and (c) subsequently moving said internal tubular actuator mandrel from said locked position to said running position for unlocking said at least one landing dog and said orienting key to permit withdrawal of said landing-orientation tool from said well casing.

8. The method of claim 7, wherein said landing-orientation tool having running shear elements securing said outer tubular body mandrel and said tubular actuator mandrel in immovable relation during running of said landing-orientation tool and having unlocking shear elements securing said tubular actuator mandrel against upward unlocking movement relative to said outer tubular body mandrel after locking has occurred, further comprising:

(a) after landing of said at least one landing dog within a landing and orienting joint of matching profile, applying sufficient downward force on said tubular actuator mandrel to shear said running shear elements and move said tubular actuator mandrel downwardly from said running position to said locking position; and (b) when retrieval of said landing-orientation tool is desired, applying sufficient upward force on said tubular actuator mandrel to shear said unlocking shear elements and move said tubular actuator mandrel from said locking position to said running position.

9. A method for drilling and reentering lateral branches within a well, comprising:

(a) providing within a well casing a plurality of landing and orienting joints each being located at a desired well depth and each defining a predetermined internal profile therein differing from the internal profiles of the other landing and orienting joints, each of said landing and orienting joints having a mule shoe therein defining at least one helical guide ramp and defining an orientation slot in registry with the helical guide ramp for rotational tool orientation during running movement of a tool within the well casing;

(b) running into the well casing a landing-orientation tool having in assembly therewith at least one landing dog having a matching profile with the predetermined internal profile of a selected one of said plurality of landing and orienting joints, the landing-orientation tool further having an orientation key for rotational orienting engagement with the helical guide ramps of said mule shoes and being adapted to enter said orientation slots when the landing-orientation tool is properly rotationally oriented, the landing-orientation tool further having a deflection whipstock defining an inclined deflection surface oriented relative to the orientation key for directional orientation of a lateral branch;

(c) landing said landing-orientation tool in said selected one of said plurality of landing and orienting joints;

(d) running a casing window mill into the well casing and in deflected contact with the inclined deflection surface of the deflection whipstock and milling an oriented window in the casing; and (e) running a branch wellbore drill through the well casing and deflecting the branch wellbore drill through the milled window of the casing by the deflection whipstock for drilling the lateral branch to the desired extent.

10. The method of claim 9, wherein the orientation key defines oppositely angulated guide surfaces for selective guiding engagement with the surfaces of said helical guide ramps, said method further comprising:

traversing a guide surface of said orientation key along the helical guide ramp surfaces of said mule shoes during downward movement of said landing-orientation tool within said landing and orienting joints for rotating said landing-orientation tool to position said orientation key in registry with said orientation slots.

11. The method of claim 10, wherein said helical guide ramps of said mule shoes and said guide surfaces of said orientation key are of matching angular relation, said method further comprising:

(a) establishing surface-to-surface bearing and guiding relation of a guide surface of said orientation key with the helical guide ramp surfaces of said mule shoes; and (b) maintaining said surface-to-surface bearing and guiding relation during movement of said orientation key along said helical guide ramps.

12. The method of claim 9, wherein said landing-orientation tool has an outer tubular body mandrel through which said at least one landing dog and said orientation key project and an inner actuator located within said outer tubular body mandrel and being linearly movable relative to said outer tubular body mandrel between a running position where said at least one landing dog and orientation key are unlocked and a locking position where said at least one landing dog and orientation key are locked, said method further comprising:

(a) securing said inner actuator in a running position where said at least one landing dog and said orientation key are unlocked;

(b) after landing of said at least one landing dog within said selected one of said plurality of landing and orienting joints having a matching profile, moving said inner actuator to said locking position for locking said at least one landing dog within the internal profile of the landing and orienting joint and locking said orientation key within said orientation slot; and (c) subsequently moving said inner actuator from said locked position to a release position for unlocking said at least one landing dog and said orientation key to permit withdrawal of said landing-orientation tool from the well casing.

13. The method of claim 12, wherein said landing-orientation tool has running shear elements securing said outer tubular body mandrel and said inner actuator in immovable relation during running of said landing-orientation tool and unlocking shear elements securing said actuator against upward unlocking movement relative to said outer tubular body mandrel after locking has occurred, said method further comprising:

(a) after landing of said at least one landing dog within the internal profile of said selected one of said plurality of landing and orienting joints, applying sufficient downward force on said actuator to shear said running shear elements and move said inner actuator downwardly from said running position to said locking position; and (b) when retrieval of said landing-orientation tool is desired, applying sufficient upward force on said inner actuator to shear said unlocking shear elements and move said inner actuator from said locking position to said running position.

14. A landing-orientation system for wells comprising:

(a) a well casing string having a plurality of landing and orienting joints connected therein, each of said landing and orienting joints having therein an internal profile differing from the internal profile of other landing and orienting joints of said well casing string;

(b) a mule shoe located with each of said landing and orienting joints and defining an upwardly projecting point, orientation slot and guide ramp surfaces extending from said point to said orientation slot; and a landing-orientation tool comprising:

(c) an elongate tool body mandrel;

(d) at least one landing dog movably mounted to said elongate tool body mandrel and having a landing profile matching said internal profile of only one of said landing and orienting joints, said at least one landing dog having upper and lower inclined end surfaces for engagement with obstructions within said casing string and landing and orienting joints to cause obstruction induced movement of said at least one landing dog to a position for clearing the obstructions;

(e) an orientation key in movable assembly with said elongate tool body mandrel and adapted for guiding engagement with said guide ramp surfaces and receivable within said orientation slot; and (f) an actuator element movable within said elongate tool body mandrel between a running position permitting radially inward movement of said at least one landing dog and said orientation key and a locking position securing said at least one landing dog within said matching profile and securing said orientation key within said orientation slot.

15. The landing-orientation system of claim 14, further comprising:

(g) means urging said at least one landing dog to a fully radially extended position thereof and yielding to permit radially retracted positioning of said at least one landing dog for clearing obstructions during movement of said landing-orientation tool within said casing string and landing and orienting joints; and (h) means urging said orientation key to a radially extended position for contact with said guide ramp surfaces and yielding to permit radially retracted movement of said orientation key to permit said orientation key to clear obstructions during movement of said landing-orientation tool within said casing string and landing and orienting joints.

16. The landing-orientation system of claim 14, wherein:

(a) said guide ramp surfaces are of generally helical configuration; and (b) said orientation key defines a pair of oppositely inclined guide surfaces of guided contact with said guide ramp surfaces for rotation of said elongate tool body mandrel to orient said orientation key in registry with said orientation slot.

17. The landing-orientation system of claim 16, wherein:

said oppositely inclined guide surfaces of said orientation key each have substantially the same angle as the angle of said guide ramp surfaces thereby establishing surface-to-surface bearing contact between an inclined guide surface and a guide ramp surface during downward movement of said landing-orientation tool within each of said landing and orienting joints.

18. The landing-orientation system of claim 14, wherein:

(a) said at least one landing dog and said orientation key each define offset upper and lower ends; and further comprising:

(b) an elongate tubular actuator mandrel located within said elongate tool body mandrel and having an upper end adapted for connection with a running tool for moving said elongate tool body mandrel through said casing string and landing and orienting joints, said elongate tubular actuator mandrel having an external locking surface and defining recesses for receiving said offset ends of said at least one landing dog and said orientation key in said running position to permit radially inward movement of said at least one landing dog and orientation key, said external locking surface being positioned to restrain radially inward movement of said at least one landing dog and orientation key at said locking position of said elongate tubular actuator mandrel.

19. The landing-orientation system of claim 18, further comprising:

running shear elements securing said elongate tubular actuator mandrel in immovable running position relative to said elongate tubular body mandrel for tool running operations, said running shear elements shearing upon application of predetermined downward force on said elongate tubular actuator mandrel and permitting movement of said elongate tubular actuator mandrel to said locking position thereof relative to said elongate tubular body mandrel.

20. The landing-orientation system of claim 18, further comprising:

(a) means securing said elongate tubular actuator mandrel to said elongate tubular body mandrel upon movement of said elongate tubular actuator mandrel to said locking position and being movable to a release position to release said elongate tubular actuator mandrel for movement to said running position; and (b) release means permitting movement of said securing means to said release position upon application of a pulling force of predetermined magnitude to said elongate tubular actuator mandrel.

21. The landing-orientation system of claim 20, wherein said securing means comprises:

(a) a top cap fixed to said elongate tubular body mandrel and defining an annular chamber about said elongate tubular actuator mandrel;

(b) a plurality of ratchet segments located within said annular chamber and in retaining engagement with said elongate tubular actuator mandrel;

(c) a ratchet retainer disposed within said annular chamber and securing said ratchet segments in retaining relation with said elongate tubular actuator mandrel; and (d) at least one releasing shear element securing said ratchet retainer in fixed relation with said top cap and being sheared upon application of predetermined pulling force to said elongate tubular actuator mandrel to thereby release said ratchet retainer from said top cap and permit upward movement of said elongate tubular actuator mandrel from said locking position to said running position.

22. A method for selective positioning, orienting and locking objects at predetermined depths within a well casing, said method comprising:

(a) providing within a well casing a plurality of landing and orienting joints each being located at a desired well depth, and each defining an internal landing profile therein differing from the internal landing profiles of the other landing and orienting joints, and each having a guide ramp therein for tool orientation during running movement within the well casing, said guide ramp having an upper end and extending from said upper end to an orientation slot;

(b) running into the well casing a landing-orientation tool having in assembly therewith at least one landing dog having a matching profile with the profile of a selected one of said plurality of landing and orienting joints, the landing-orientation tool further having an orientation key for engagement with said guide ramp of the landing and orienting joint being entered for rotating said landing-orientation tool to a predetermined angular position in registry with said orientation slot; and (c) during said running of said landing-orientation tool, passing said landing-orientation tool through landing and orienting joints not having a matching internal landing profile and landing said landing-orientation tool within a landing and orienting joint having a matching profile.

23. A landing-orientation system for wells comprising:

(a) a well casing string having a plurality of landing and orienting joints connected therein, each of said landing and orienting joints having therein an internal profile differing from the internal profile of other landing and orienting joints of said well casing string;

(b) a guide ramp located with each of said landing and orienting joints, said guide ramp having an upper end and extending from said upper end to an orientation slot; and a landing-orientation tool comprising:

(c) an elongate tool body mandrel;

(d) at least one landing dog movably mounted to said elongate tool body mandrel and having a profile matching said internal profile of only one of said landing and orienting joints; and (e) an orientation key in movable assembly with said elongate tool body mandrel and adapted for engagement with said guide ramps and receivable within said orientation slots.

24. The landing-orientation system of claim 23 wherein said at least one landing dog has upper and lower inclined end surfaces for engagement with obstructions within said well casing string and said landing and orienting joints to cause obstruction induced movement of said at least one landing dog to a position for clearing the obstructions.

25. The landing-orientation system of claim 23 wherein said landing-orientation tool further comprises an actuator element movable within said elongate tool body mandrel between a running position permitting radially inward movement of said at least one landing dog and said orientation key and a locking position securing said at least one landing dog within said matching internal profile and securing said orientation key within said orientation slot.

26. A method for drilling and reentering lateral branches within a well, comprising:

(a) providing within a well casing a plurality of landing and orienting joints each being located at a desired well depth and each defining a predetermined internal profile therein differing from the internal profiles of the other landing and orienting joints, each of said landing and orienting joints having at least one guide ramp therein and defining an orientation slot in registry with the guide ramp for rotational tool orientation during running movement of a tool within the well casing;

(b) running into the well casing a landing-orientation tool having in assembly therewith at least one landing dog having a matching profile with the predetermined internal profile of a selected one of said plurality of landing and orienting joints, the landing-orientation tool further having an orientation key for rotational orienting engagement with the guide ramps of said landing and orienting joints and being adapted to enter said orientation slots when the landing-orientation tool is properly rotationally oriented, the landing-orientation tool further having a deflection whipstock defining an inclined deflection surface oriented relative to the orientation key for directional orientation of a lateral branch;

(c) landing said landing-orientation tool in said selected one of said plurality of landing and orienting joints;

(d) running a casing window mill into the well casing and in deflected contact with the inclined deflection surface of the deflection whipstock and milling an oriented window in the casing; and (e) running a branch wellbore drill through the well casing and deflecting the branch wellbore drill through the milled window of the casing by the deflection whipstock for drilling the lateral branch to the desired extent.

* * * * *